US005653556A

United States Patent [19]

White

[11] Patent Number: 5,653,556

[45] Date of Patent: Aug. 5, 1997

[54] CLAMPING APPARATUS AND METHODS FOR DRIVING CAISSONS INTO THE EARTH

[75] Inventor: John L. White, Kent, Wash.

[73] Assignee: American Piledriving Equipment, Inc., Kent, Wash.

[21] Appl. No.: 541,322

[22] Filed: Oct. 10, 1995

[51] Int. Cl.[6] ..... E21B 1/02

[52] U.S. Cl. ..... 405/249; 173/49; 173/162.1; 175/171; 175/135

[58] Field of Search ..... 405/249, 253, 405/228, 231, 232; 173/49, 162.1; 175/56, 135, 171

[56] References Cited

U.S. PATENT DOCUMENTS

| | | | |
|---|---|---|---|
| 1,787,000 | 12/1930 | Hunt | 405/249 |
| 3,115,198 | 12/1963 | Kuss | 405/249 X |
| 3,530,947 | 9/1970 | Gendron | 405/249 X |
| 3,686,877 | 8/1972 | Bodin | 405/249 X |
| 3,828,864 | 8/1974 | Haverkamp et al. | 173/49 |
| 4,143,985 | 3/1979 | Axelsson et al. | 405/231 X |
| 5,117,925 | 6/1992 | White | 173/162 |
| 5,263,544 | 11/1993 | White | 173/162 |
| 5,544,979 | 8/1996 | White | 405/232 |
| 5,549,168 | 8/1996 | Sadler et al. | 173/49 |

FOREIGN PATENT DOCUMENTS

| | | | |
|---|---|---|---|
| 0362158 | 4/1990 | European Pat. Off. . | |
| 4010357 A1 | 10/1990 | Germany . | |
| 221416 | 10/1986 | Japan | 173/49 |
| 406136751 | 5/1994 | Japan | 173/49 |

*Primary Examiner*—Hoang C. Dang

*Attorney, Agent, or Firm*—Michael R. Schacht; Hughes, Multer & Schacht, P.S.

[57] ABSTRACT

An apparatus for attaching a caisson to a device for inserting and/or extracting the caisson. The apparatus comprises three beams. A first beam is relatively long and is normally connected to a vibratory device such that its longitudinal axis is orthogonal to the lengthwise axis of the vibratory device. The second and third beams are relatively short and are connected to the vibratory device such their longitudinal axes are parallel to the lengthwise axis of the vibratory device. Four clamps are mounted on the beams to fix the beams onto the caisson. A flange on the first beam is widened at least a middle portion thereof to stiffen the beam and allow the beam to be securely connected to the vibratory device. The first beam may also be used with its longitudinal axis parallel to the lengthwise axis of the vibratory device.

21 Claims, 5 Drawing Sheets

CLAMPING APPARATUS AND METHODS FOR DRIVING CAISSONS INTO THE EARTH

TECHNICAL FIELD

The present invention relates to clamps that allow vibratory devices to be attached to elongate members and, more particularly, such clamps that are adapted to connect a vibratory device to a caisson to allow the caisson to be driven into the earth.

BACKGROUND OF THE INVENTION

In the construction industry, it is often necessary to insert pipe-like bodies into the earth. Such pipe like bodies are referred to as caissons in most situations and often as casings in the context of a pipe that is inserted into the earth during drilling operations.

As examples, caissons are inserted into the earth during new construction as part of a foundation for a structure; caissons are also commonly driven under a bridge or the like when providing additional structural resistance to earthquake damage. Casings are employed when drilling a hole to prevent the earth from collapsing into the hole as it is drilled.

In this application, the term "caisson" will be used to refer to any pipe like body that is driven into the earth, including the casings used in drilling operations.

To insert a caisson into the earth, a large driving force must be applied thereto. Often, vibratory devices are employed to introduce a vibratory force along the axis of the caisson during the driving process. The combination of a static driving force with a dynamic vibratory force is usually sufficient to overcome the earth's resistance and allow the caisson to be inserted therein.

A clamping assembly must be provided to allow vibratory forces to be effectively transmitted to the caisson. Such clamping assemblies have heretofore normally been adapted to engage the upper end of the caisson. But as described in copending patent application Ser. No. 08/408,023 filed by the present inventor, now the U.S. Pat. No. 5,544,979, clamp assemblies also exist that grip the side of the caisson as it is being driven into the earth.

The present invention relates to clamp assemblies that engage the upper end of the caisson. Normally, such clamp assemblies comprise a cast beam having individual clamps movably mounted on each end thereof. A vibratory device is bolted to an upper surface of the beam. The beam is then arranged above the caisson upper end and lowered such that opposing portions of the caisson upper end are received between gripping members of the clamps. The clamps are then actuated such that the gripping members grip the caisson upper end and thus fix the caisson relative to the vibratory device.

The vibratory device is then operated to create a vibratory force that, in combination with the weight of the vibratory device, clamping assembly, and caisson, drives the caisson into the earth.

This arrangement usually works well with caissons of relatively small diameter. With larger caisson diameters, however, the vibratory forces often cause walls of the caisson to vibrate, or diaphragm, especially under hard soil conditions. This diaphragming of the caisson absorbs the vibratory driving forces, preventing the caisson from being driven into the earth and oftentimes resulting in damage to the caisson. At a minimum, diaphragming requires that the driving process be performed more slowly.

An undesirable side effect of diaphragming of the caisson is that the vibratory forces are transmitted laterally by the caisson walls into the adjacent soil instead of vertically through the caisson to the lower end thereof. In many situations, such as when the caisson is being inserted adjacent to a building or other structure, these laterally transmitted vibratory forces are highly undesirable because they might unduly stress the adjacent structure.

The most common method of overcoming the problem of diaphragming is simply to increase the wall thickness of the caisson. The thicker caisson wall results in a more rigid caisson that resists diaphragming and can therefore be more easily driven into the earth.

Caissons with thicker walls are significantly more expensive, however, and the need exists for apparatus and methods for driving caisson assemblies into the earth that allow the use of thin walled caissons under more circumstances.

OBJECTS OF THE INVENTION

From the foregoing, it should be clear that one primary object of the present invention is to provide an improved clamp assembly for securely attaching a vibratory device or the like to a caisson.

A further object of the invention is to provide a caisson clamp assembly having a favorable combination of the following characteristics:

(a) allows the use of lighter, thin walled caissons;

(b) allows the use of a smaller crane;

(c) allows piles to be driven more quickly;

(d) ensures that piles stay plumb as they are driven;

(e) reduces or eliminates lateral vibrations that are transmitted to the soil and thus possibly to adjacent structures;

(f) transfers forces to the caisson in balanced, stable manner;

(g) allows caissons to be driven deeper;

(h) can be adapted to grip a caisson at either two points or at four points; and (i) is inexpensive to manufacture and use.

As will become clear from the following detailed discussion, these and other objects are achieved by the caisson clamping assembly of the present invention.

SUMMARY OF THE INVENTION

The present invention comprises a clamp assembly for caissons having a first rigid member, a second rigid member, a third rigid member, and first through fourth clamps. Two of the clamps are attached to the first rigid member, while the remaining clamps are attached one each to the second and third rigid members.

The rigid members may be in the form of cast I-beams having an upper flange. The upper flanges of the rigid members are attached to a vibratory device such that the second and third rigid members are parallel to a longitudinal axis of the vibratory device and the first rigid member is perpendicular to this longitudinal axis. The clamps are attached to a caisson to be driven into the ground. The clamp assembly provides clamps at four points spaced at equal intervals around the circumference of the caisson.

By providing four equally spaced points of attachment around the upper edge of the caisson, vibratory loads imparted to the caisson through the clamp assembly are evenly distributed in a manner that alleviates or prevents diaphragming of the caisson as it is being driven. Without the diaphragming, the vibratory forces are less likely to vibrate the soil. The even distribution of loads also helps to keep the caisson plum as it is driven. The clamp assembly of the present invention also allows the use of a smaller crane and speeds up driving times.

By eliminating or substantially reducing diaphragming, the clamping assembly of the present invention also greatly reduces the magnitude of lateral forces transmitted to the soil. Caissons may be driven with the present clamping assembly in locations, such as adjacent to preexisting structures, where they could not have been driven using prior art devices.

Additionally, the use of three separate rigid members both: (a) reduces manufacturing costs; and (b) increases the flexibility of the clamping assembly during use. Manufacturing costs are reduced because each of the rigid members is a simple I-beam that may be easily cast using conventional techniques.

Flexibility during use is increased because the first rigid member may, when appropriate, be arranged parallel to the longitudinal axis of the vibratory device and used in a conventional manner with two points of attachment. Then, when circumstances dictate, it may be arranged perpendicular to this longitudinal axis and used with the first and second rigid members with four points of attachment. Successive caissons may be driven using the same equipment even though they are of much different diameters and/or are driven under different soil conditions.

To provide a stable and secure connection between the clamp assembly and the vibratory device, the upper flange of the first rigid member may be thickened at its central portion relative to the ends of the upper flange and/or the upper flanges of the second and third rigid members.

Constructed in this manner, the clamp assembly of the present invention provides a secure four-point attachment system that reduces diaphragming in a flexible manner and at low cost.

DETAILED DESCRIPTION

Figure 1:
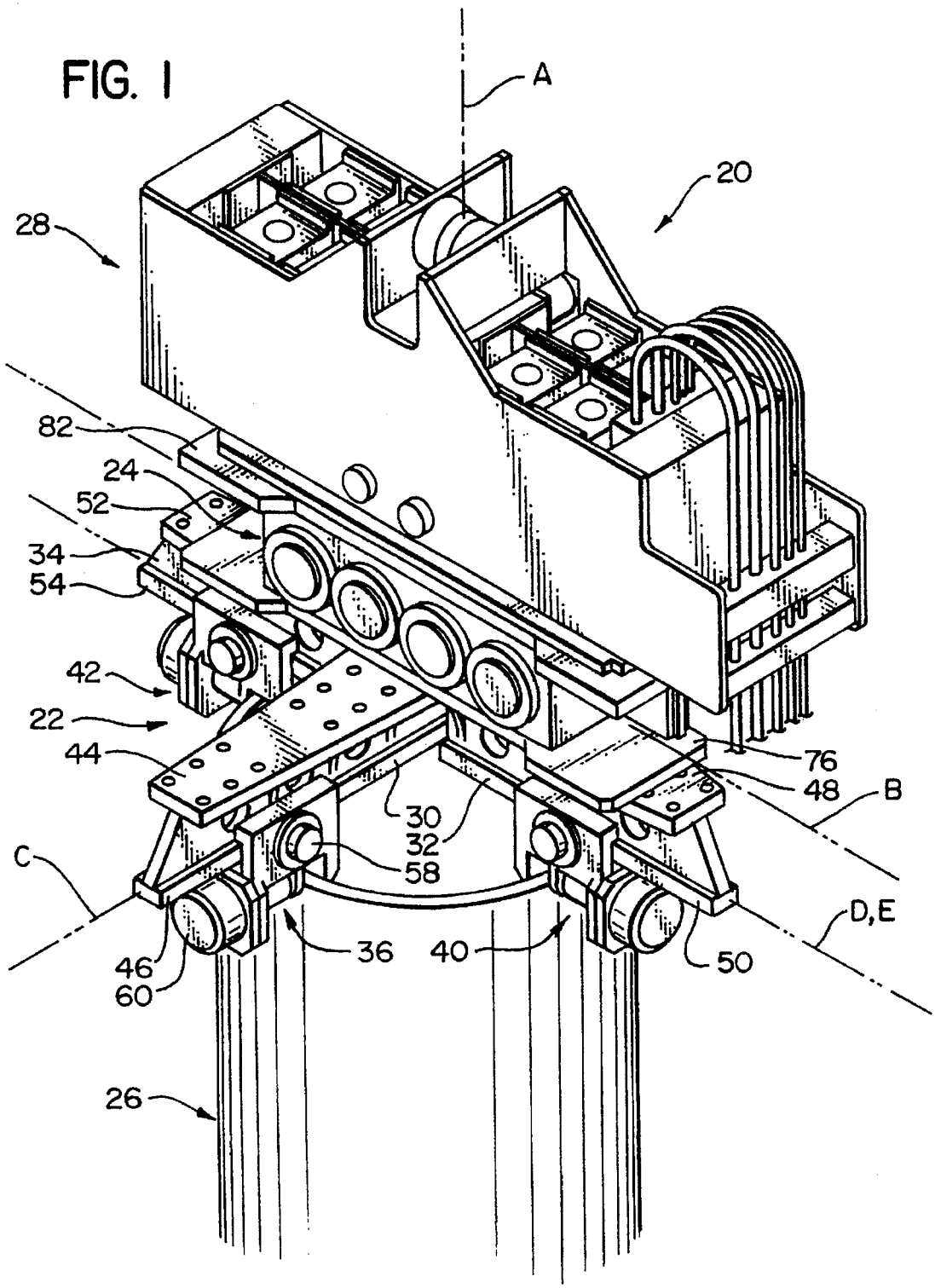
FIG. 1 is a perspective view depicting a clamping assembly of the present invention being used in a first mode of use.

Referring now to the drawing, depicted at 20 in FIG. 1 is a driving device employing a clamping assembly 22 constructed in accordance with, and embodying, the principles of the present invention. The clamping assembly 22 secures a vibratory device 24 to a caisson 26. The vibratory device 24 itself is connected to a suppresser unit 28.

In operation, the suppresser unit 28 is connected to a cable suspended by a crane in a manner that is well known in the art. The vibratory device 24 generates vertical vibratory loads that are imparted to the caisson 26 through the clamping assembly 22 along a vibratory axis A as shown in FIG. 1. A static driving force is also applied by the weight of the entire driving device 20. The suppresser unit 28 substantially isolates the cable and crane from the vertical vibratory forces generated by the vibratory device 24.

Of the foregoing components, the vibratory device 24, caisson 26, and suppresser unit 28 are all known in the art and will not be described in detail herein. The exemplary vibratory device 24 and suppresser 28 shown and described herein are available from the assignee of the present application under the trademark KING KONG.

Referring now to FIGS. 1–5, it can be seen that the clamping assembly 22 comprises first, second, and third beam members 30, 32, and 34 and first through fourth clamps 36, 38, 40, and 42.

In the following discussion, the following axes are illustrated in FIG. 1 to clarify certain features of the present invention. The vibratory axis A, which is normally vertical, coincides with the longitudinal axis of the caisson 26. The vibratory device is generally elongate in overall configuration and has a lengthwise axis B that is orthogonal to the vibratory axis. The beam members 30–34 are also elongate, with the first beam member having a first beam axis C, the second beam member having a second beam axis D, and the third beam member having a third beam axis E.

The beam members 30–34 are I-beams, each having upper and lower flanges. A first upper flange 44 and first lower flange 46 are formed on the first beam member 30. Similarly, a second upper flange 48 and second lower flange 50 are formed on the second beam member 32, while a third upper flange 52 and third lower flange 54 are formed on the third beam member 34.

The upper flanges 44, 48, and 52 have holes 56 formed therein to allow the beam members 30–34 to be connected to the vibratory device 24 by bolts or the like as will be described in further detail below.

Figure 6:
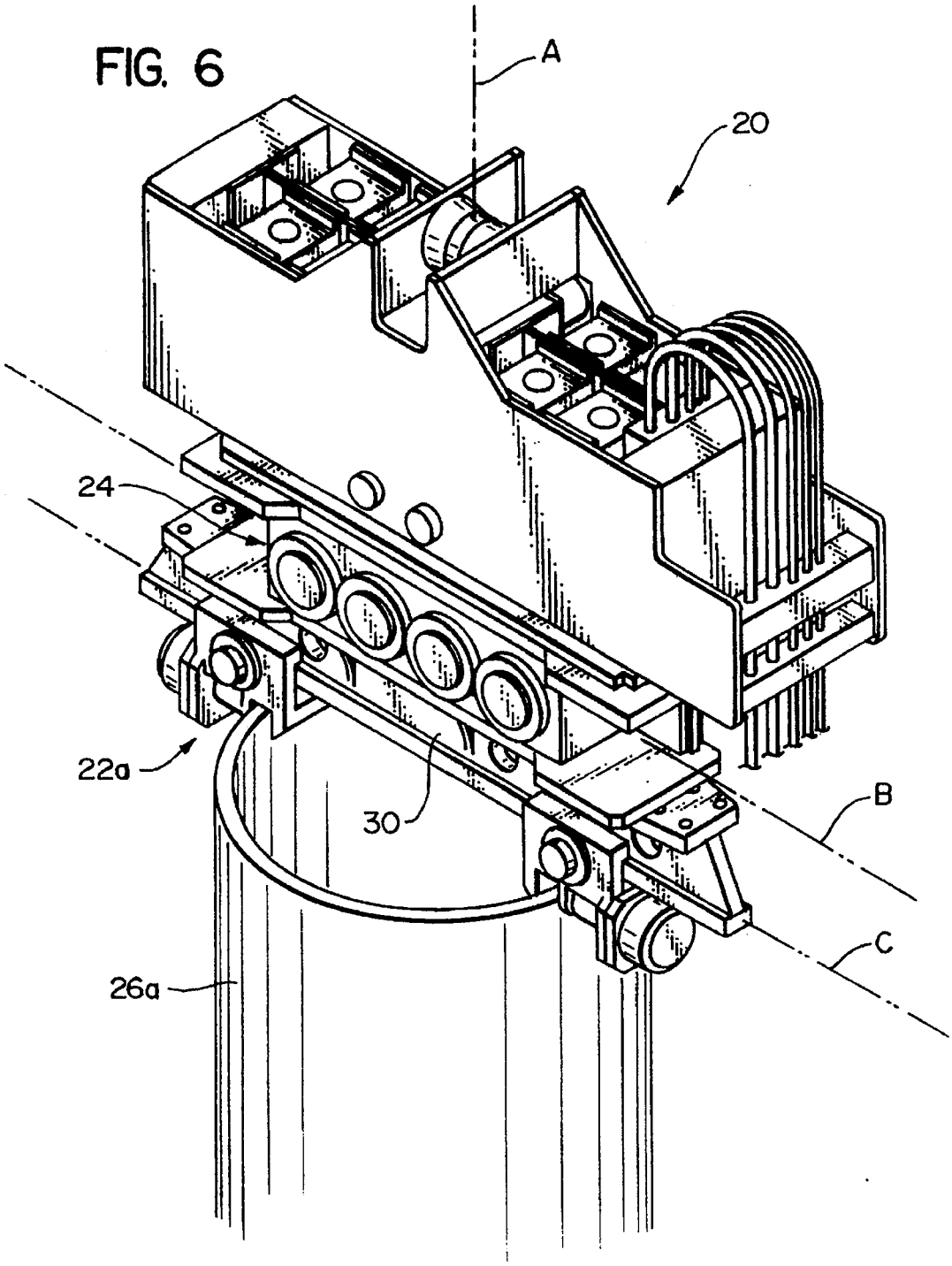
FIG. 6 is a perspective view depicting a clamping assembly of the present invention being used in a second mode of use.

As perhaps best shown in FIG. 1, the clamps 36–42 engage the lower flanges 46, 50, and 54 such that these clamps 36–42 can slide along the beam axes C, D, and E but do not move relative to the beams 30–34 along the vibratory axis A. As shown in FIG. 6, the first and second clamps 36 and 38 are attached to the first beam member 30, the third clamp 40 is attached to the second beam member 32, and the fourth clamp 42 is attached to the third beam member 34.

The clamps 36–42 are identical and well known in the art and will be described herein only briefly to illustrate the operation of the present invention. Basically, referring to the first clamp 36, it can be seen that this clamp 36 comprises a first hydraulic cylinder 58 for securing the clamp 36 relative to the beam 30 and a second hydraulic cylinder 60 securing the clamp 36 to the caisson 26.

Referring again now to FIG. 5, one important feature of the present invention is the use and arrangement of the beam members 30–34 relative to the caisson 26 and vibratory device 24. Referring initially to the relationship between the beam members 30–34 and the vibratory device 24, it can be seen in FIG. 1 that the lengthwise axis C of the first beam member 30 is substantially orthogonal to the lengthwise axis B of the vibratory device. The lengthwise axes D and E of the second and third members 32 and 34 are substantially parallel to the lengthwise axis B of the vibratory device 24.

Figure 5:
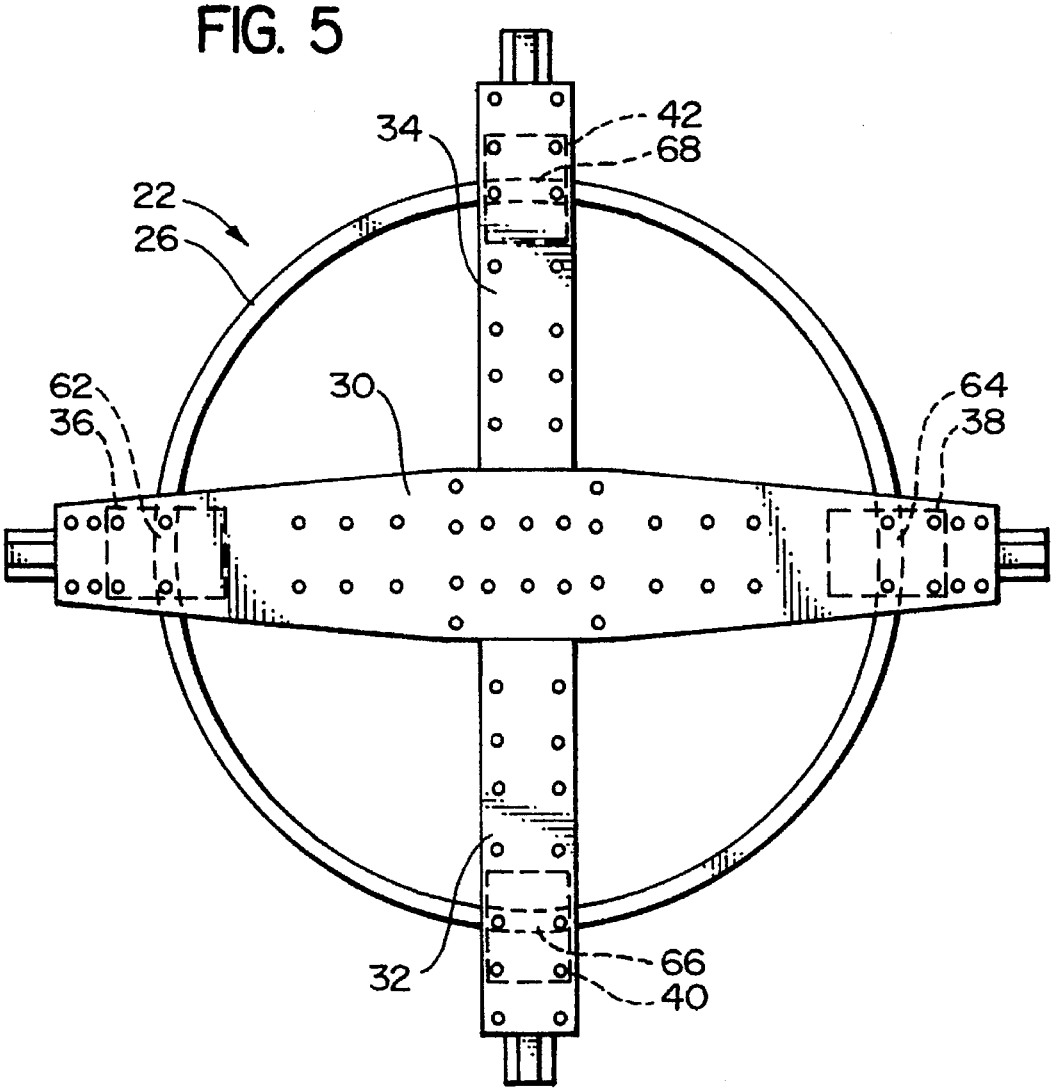
FIG. 5 is a somewhat schematic view showing the relationship between the clamping assembly shown in FIG. 1 and the caisson being driven therewith.

As shown in FIG. 5, this results in the beams 30–34 being arranged in a substantially cruciform shape during use. FIG.

5 also shows that this cruciform shape results in the clamp assembly 22 engaging the caisson 26 at four different gripping locations 62, 64, 66, and 68. Additionally, with the exemplary clamping assembly 22, these clamping locations 62–68 are all spaced at substantially equal 90° intervals from each other. This even spacing of the clamping locations 62–68 results in a more even distribution of vibratory loads being applied to the caisson 26, which dampens the diaphragming that tends to occur without such even spacing.

Another feature of the present invention is that the clamping assembly 22 is formed from three separate beam members 30–34. Each of these beam members is a cast I-beam that is relatively easy to fabricate. These separate beam members 30–34 are also relatively easy to store and handle when not in use or during assembly for use.

Figure 2:
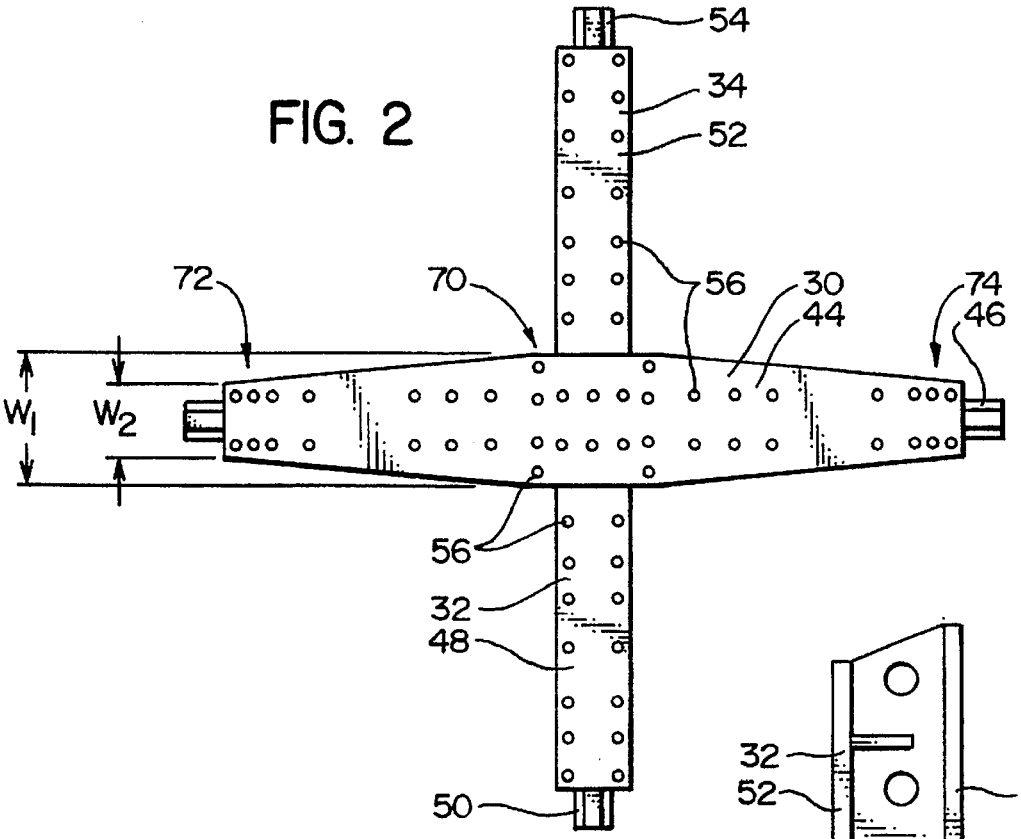
FIG. 2 is a top plan view of beam members of the clamping assembly shown in FIG. 1.
Figure 3:
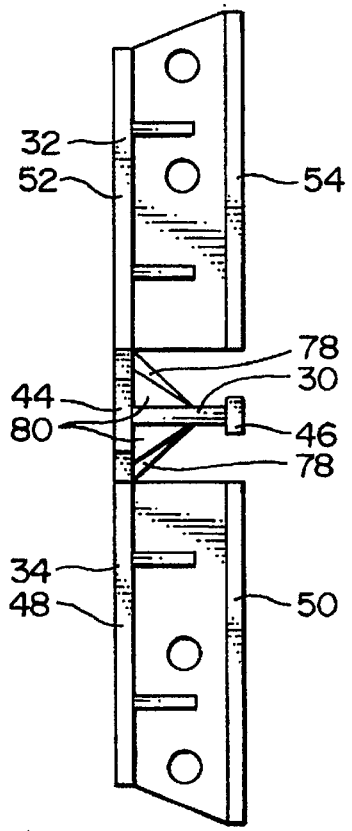
FIG. 3 is a front plan view of the beam members shown in FIG. 2.
Figure 4:
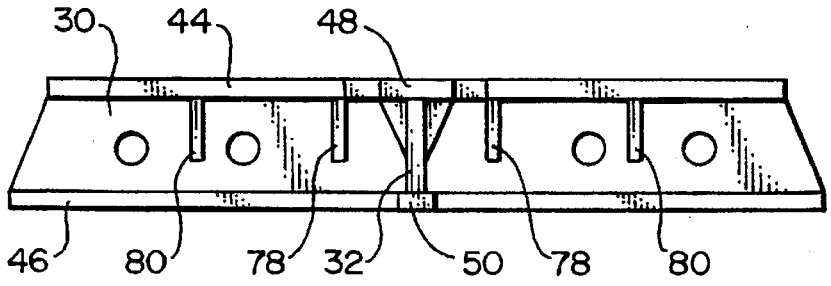
FIG. 4 is a side plan view of the beam members shown in FIG. 2.

FIGS. 2, 3, and 6 also show that the first beam member 30 is slightly more than twice as long as the second and third beam members 32 and 34.

Additionally, the first upper flange 44 of the first beam member 30 is not of uniform size. In particular, as shown in FIG. 2, a width W1 of the first upper flange 44 at a central location 70 is almost twice that of a width W2 of the first upper flange 44 at end locations 72 and 74. The widths W1 and W2 are measured in a direction orthogonal the first longitudinal axis C of the first beam member 30 and to the driving axis A.

The thickened central portion 70 provides a larger surface area for attachment to the vibratory device 24 that allows more bolts to be employed to attach the first beam member 30 to a base plate 76 of the vibratory device 24. This thickened central portion 70 also rigidifies the first beam member 30 to accommodate the additional loads that must be transferred in the smaller contact area resulting from the fact that the first beam member 30 is transverse to the vibratory device 24.

In the exemplary clamping device 22, the width W1 of the central location is at least 25% of the length of the vibratory device along the lengthwise axis B thereof. The width W2 is at most 20% of the length of the vibratory device along the lengthwise axis B. This arrangement provides a stable, rigid, and balanced configuration to the clamping device 20.

As shown in FIG. 3, a plurality of brace members 78 and 80 are formed as part of the first beam member 30 to provide additional support for the first upper flange 44. The brace members 78 are larger than the brace members 80 to accommodate the thickened central portion 70 of the first upper flange 44.

The clamping assembly 22 described above is used in the following manner. Initially, the vibratory device 24 and suppresser 28 are obtained as a unit or assembled together so that the suppresser 28 is rigidly connected to an upper plate 82 of the vibratory device. The first beam member 30 is bolted to the base plate 76 of the vibratory device 24 such that its lengthwise axis C is orthogonal to the lengthwise axis B of the vibratory device 24. The second and third beam members 32 and 34 are next bolted to the base plate 76 such that they are on opposite sides of the first beam member 30 and their longitudinal axes D and E are substantially parallel to the vibratory device lengthwise axis B. The entire assembly 20 is then suspended above the caisson 26.

At this point or earlier if the diameter of the caisson 26 is known, the clamps 36–42 are arranged on their respective beam members such that they are symmetrically arranged around the vibratory axis A and spaced from each other a distance necessary to accommodate the diameter of the caisson 26. The entire driving device 20 is then lowered to a position where the clamps 36–42 straddle the engaging portions 62–68 of the caisson 26. The second hydraulic cylinder 60 are then operated to lock the clamps 36–42 relative to the caisson 26. The first hydraulic cylinders 58 are then actuated to lock the clamp members 36–42 relative to the first through third beam members 30–34.

The vibratory device 24 is now rigidly connected to the four gripping portions 62–68 through the clamping assembly 22. The vibratory device may then be actuated to apply a vibratory load to the caisson 26 for the purpose of driving or pulling the caisson 26.

In addition to the first mode of operation shown above with respect to FIGS. 1–6, the clamping assembly 22 has the additional flexibility to be used in a traditional manner with two points of contact. In particular, FIG. 7 shows the clamping device 20 with a clamping assembly 22*a* thereof arranged in a second mode of operation.

Figure 7:
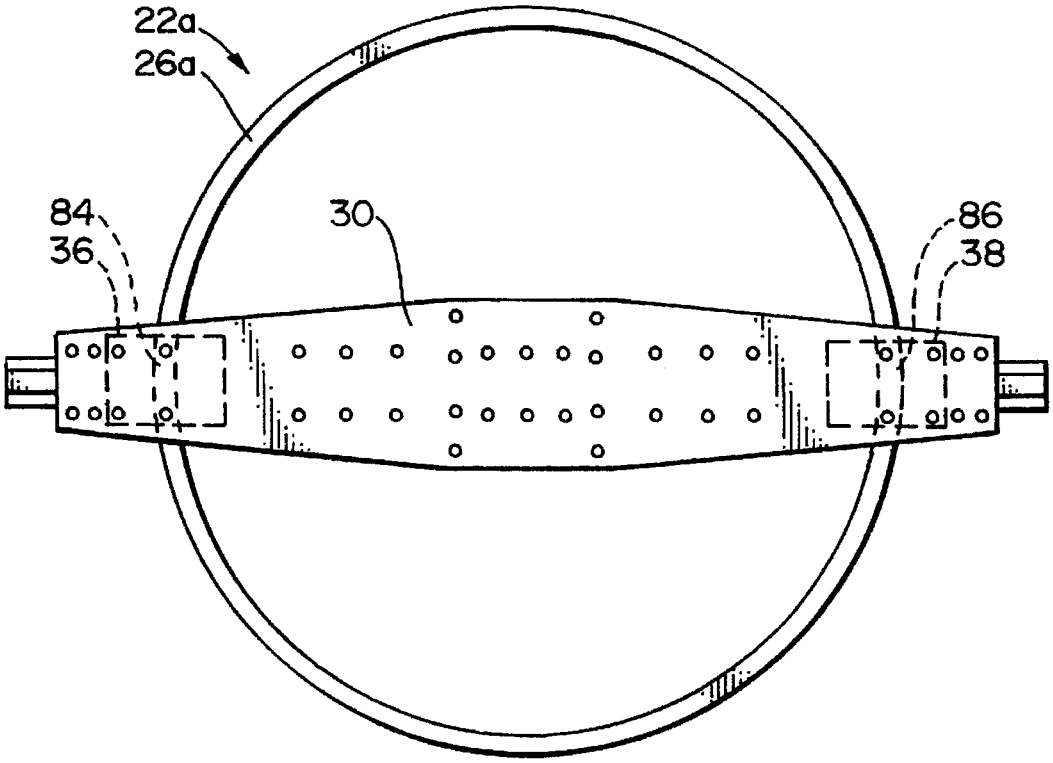
FIG. 7 is a somewhat schematic view showing the relationship between the clamping assembly shown in FIG. 6 and the caisson being driven therewith.

As shown in FIGS. 7 and 8, in this second mode of operation the first beam member 30 may be used without the second and third beam members 32 and 34. In this second mode, the longitudinal axis C of the first beam member 30 is arranged substantially parallel to the longitudinal axis B of the vibratory device 24.

The clamping assembly 22*a* of this second mode of use operates in the same basic manner as that of the clamping assembly 22 described above except that, as shown in FIG. 8, the assembly 22*a* grips the caisson 26*b* in two gripping locations 84 and 86 that are spaced 180° from each other.

The same equipment may thus be used in either of two ways depending upon the situation. In some situations, caissons may be driven in succession using the clamping assembly either in its first mode 22 or in its second mode 22*a*.

From the foregoing, it should be clear to one of ordinary skill in the art that the present invention may be embodied in forms other than those described above in detail. For example, while the exemplary clamping assembly 22 described above preferably contacts caisson at four gripping locations, at least some advantages of the present invention may be obtained by using a clamping assembly that contacts the caisson at three evenly spaced locations. While not yielding many of the benefits of the clamping assembly 22 described above, applying the vibratory forces at more than two (i.e., three or more) evenly spaced gripping locations will result in a balanced configuration that will reduced diaphragming.

The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. An apparatus for securing a caisson to a driving apparatus for driving the caisson into the earth, the driving apparatus having a base plate and defining a lengthwise axis, the apparatus comprising:

a first beam member having a first upper flange and defining a first longitudinal axis;

a second beam member having a second upper flange and defining a second longitudinal axis;

a third beam member having a third upper flange and defining a third longitudinal axis;

first and second clamp means for fixedly securing first and second gripping portions of the caisson to the first beam member;

third clamp means for fixedly securing a third gripping portion of the caisson to the second beam member;

fourth clamp means for fixedly securing a fourth gripping portion of the caisson to the third beam member; and means for securing the first, second, and third upper flanges to the base plate such that the first longitudinal axis is substantially orthogonal to the lengthwise axis of the base plate, the second and third axes are substantially parallel to the lengthwise axis of the base plate, and the first beam member is located between the second and third beam members.

2. An apparatus as recited in claim 1, in which each of the first, second, third, and fourth ripping portions of the caisson are equidistant from the gripping portions adjacent thereto.

3. An apparatus as recited in claim 1, in which the first, second, third, and fourth gripping portions of the caisson are spaced at 90° intervals along a circumference of the caisson.

4. An apparatus as recited in claim 1, in which a lateral dimension of the first flange in a direction orthogonal to the first longitudinal axis is larger at a center portion of the first beam member than at first and second end portions of the first beam member.

5. An apparatus as recited in claim 1, in which a lateral dimension of the first flange in a direction orthogonal to the first longitudinal axis is at least 25% of a length of the base plate along the lengthwise axis.

6. An apparatus as recited in claim 1, in which a lateral dimension of the first flange in a direction orthogonal to the first longitudinal axis is, at a center portion of the first flange, at least 25% of a length of the base plate along the lengthwise axis and is, at first and second end portions of the first flange, at most 20% of the length of the base plate along the lengthwise axis.

7. An apparatus as recited in claim 1, in which a length of the base plate along the lengthwise axis is approximately the same as a total of a lateral dimension of the first flange in a direction orthogonal to the first longitudinal axis, a length of the second flange along the second longitudinal axis, and a length of the third flange along the third longitudinal axis.

8. An apparatus for securing a caisson to a driving apparatus for driving the caisson into the earth, the driving apparatus having a base plate and defining a lengthwise axis, the apparatus comprising:

a first beam member having a first upper flange, a first vertical flange, and a first lower flange and defining a first longitudinal axis;

a second beam member having a second upper flange, a second vertical flange, and a second lower flange and defining a second longitudinal axis;

a third beam member having a third upper flange, a third vertical flange, and a third lower flange and defining a third longitudinal axis;

first and second clamp means for fixedly securing first and second gripping portions of the caisson to the first lower flange;

third clamp means for fixedly securing a third gripping portion of the caisson to second lower flange;

fourth clamp means for fixedly securing a fourth gripping portion of the caisson to the third lower flange; and means for securing the first, second, and third upper flanges to the base plate such that the first longitudinal axis is substantially orthogonal to the lengthwise axis of the base plate, the second and third axes are substantially parallel to the lengthwise axis of the base plate, and the first beam member is located between the second and third beam members.

9. An apparatus as recited in claim 8, in which each of the first, second, third, and fourth gripping portions of the caisson are equidistant from the gripping portions adjacent thereto.

10. An apparatus as recited in claim 9, in which the first, second, third, and fourth gripping portions of the caisson are spaced at 90° intervals along a circumference of the caisson.

11. An apparatus as recited in claim 8, in which a lateral dimension of the first flange in a direction orthogonal to the first longitudinal axis is larger at a center portion of the first beam member than at first and second end portions of the first beam member.

12. An apparatus as recited in claim 8, in which a lateral dimension of the first flange in a direction orthogonal to the first longitudinal axis is at least 25% of a length of the base plate along the lengthwise axis.

13. An apparatus as recited in claim 8, in which a lateral dimension of the first flange in a direction orthogonal to the first longitudinal axis is, at a center portion of the first flange, at least 25% of a length of the base plate along the lengthwise axis and is, at first and second end portions of the first flange, at most 20% of the length of the base plate along the lengthwise axis.

14. An apparatus as recited in claim 8, in which a length of the base plate along the lengthwise axis is approximately the same as a total of a lateral dimension of the first flange in a direction orthogonal to the first longitudinal axis, a length of the second flange along the second longitudinal axis, and a length of the third flange along the third longitudinal axis.

15. A method of driving a plurality of caissons into the earth in succession, the method comprising the steps of:

providing a vibratory device having a base plate and defining a lengthwise axis;

providing a first beam member having a first upper flange and defining a first longitudinal axis;

providing a second beam member having a second upper flange and defining a second longitudinal axis;

providing a third beam member having a third upper flange and defining a third longitudinal axis;

mounting first and second clamps on the first beam member;

mounting a third clamp on the second beam member;

mounting a fourth clamp on the third beam member;

securing the first upper flange to a center portion of the base plate such that the first longitudinal axis is substantially orthogonal to the lengthwise axis;

securing the second and third upper flanges to first and second end portions, respectively, of the base plate such that the second and third axes are substantially parallel to the lengthwise axis of the base plates;

operating the first, second, third, and fourth clamps to grip first, second, third, and fourth portions of a first caisson, respectively;

operating the vibratory device to drive the first caisson into the ground;

removing the first, second, and third beam members from the base plate;

securing the first upper flange to the base plate such that the first longitudinal axis is substantially parallel to the lengthwise axis;

operating the first and second clamps to grip first and second portions of a second caisson, respectively; and operating the vibratory device to drive the second caisson into the ground.

16. A method as recited in claim 15, in which the first, second, third, and fourth gripping portions of the first caisson are spaced at 90° intervals along a circumference of the first caisson.

17. A method as recited in claim 16, in which the first and second gripping portions of the second caisson are spaced at 180° intervals along a circumference of the second caisson.

18. A method as recited in claim 15, in which a lateral dimension of the first flange in a direction orthogonal to the first longitudinal axis is larger at a center portion of the first beam member than at first and second end portions of the first beam member.

19. A method as recited in claim 15, in which a lateral dimension of the first flange in a direction orthogonal to the first longitudinal axis is at least 25% of a length of the base plate along the lengthwise axis.

20. A method as recited in claim 15, in which a lateral dimension of the first flange in a direction orthogonal to the first longitudinal axis is, at a center portion of the first flange, at least 25% of a length of the base plate along the lengthwise axis and is, at first and second end portions of the first flange, at most 20% of the length of the base plate along the lengthwise axis.

21. A method as recited in claim 15, in which a length of the base plate along the lengthwise axis is approximately the same as a total of a lateral dimension of the first flange in a direction orthogonal to the first longitudinal axis, a length of the second flange along the second longitudinal axis, and a length of the third flange along the third longitudinal axis.

* * * * *